US006026802A

United States Patent [19]

Patterson

[11] Patent Number: 6,026,802

[45] Date of Patent: Feb. 22, 2000

[54] OUTDOOR APPLIANCE ENCLOSURE

[76] Inventor: James F. Patterson, 1527 George Hurst Rd., Guyton, Ga. 31312

[21] Appl. No.: 08/963,206

[22] Filed: Nov. 3, 1997

[51] Int. Cl.[7] ..... F24C 15/36

[52] U.S. Cl. ..... 126/201; 126/9 B

[58] Field of Search ..... 126/42, 58, 214 R, 126/59.5, 201, 9 B, 9 R, 544; 160/DIG. 9, 121, 135

[56] References Cited

U.S. PATENT DOCUMENTS

| | | | |
|---|---|---|---|
| 197,963 | 12/1877 | Clifford | 129/9 R |
| 506,058 | 10/1893 | Mings . | |
| 1,255,033 | 1/1918 | McNutt | 126/201 |
| 2,361,247 | 10/1944 | Swenson | 126/29 |
| 2,424,665 | 7/1947 | Pope, Sr. | 126/9 R |
| 3,384,066 | 5/1968 | Tufts | 126/9 R |
| 3,905,754 | 9/1975 | Maddestra et al. | 431/324 |
| 4,489,706 | 12/1984 | Hait | 126/9 B |
| 4,544,348 | 10/1985 | Boij | 431/146 |
| 4,640,679 | 2/1987 | Perrin | 431/146 |
| 4,773,391 | 9/1988 | Alexander | 126/361 |
| 5,199,413 | 4/1993 | Chen | 126/43 |

*Primary Examiner*—Carl D. Price
*Attorney, Agent, or Firm*—J. Stewart Brams

[57] ABSTRACT

Four rectangular, planar, hingedly connected first walls are adapted to close around an appliance, such that each of the first walls is oriented vertically. Each of the first walls has a susbtantially triangular, substantially planar second wall hingedly connected thereto. The second walls are configured to rest in a substantially horizontal position extending from tops of the first walls when the enclosure is in use, the second walls forming an enclosure lid having an opening adapted to permit the appliance to extend there-through.

5 Claims, 2 Drawing Sheets

OUTDOOR APPLIANCE ENCLOSURE

BACKGROUND OF THE INVENTION

1. Field of the Invention

The present invention relates to enclosures, particularly to enclosures for outdoor appliances having burners.

2. Description of the Related Art

Outdoor appliances with burners are in common use, as grills, cookers, smokers, fryers, heaters and more. A number of problems occur with such outdoor appliances. For example, wind can blow out the burners. Further, children, pets and even adults can become burned from contact with the appliance. Additionally, wind blown sparks from these appliances can even cause a fire.

What is needed is an apparatus which conveniently and reliably mitigates the above stated problems.

SUMMARY OF THE INVENTION

The appliance enclosure of the present invention includes four rectangular, planar, hingedly connected first walls, adapted to close around an appliance, such that each of the first walls is oriented vertically. Each of the first walls has a substantially triangular, substantially planar second wall hingedly connected thereto. The second walls are configured to rest in a substantially horizontal position extending from tops of the first walls when the enclosure is in use, the second walls forming an enclosure lid having an opening adapted to permit the appliance to extend there-through. The first and second walls may be connected by loosely fitting hinge pins, so that they are easily separable from one another.

Still further features and advantages will become apparent from the ensuing description and drawings.

DETAILED DESCRIPTION

Figure 1:
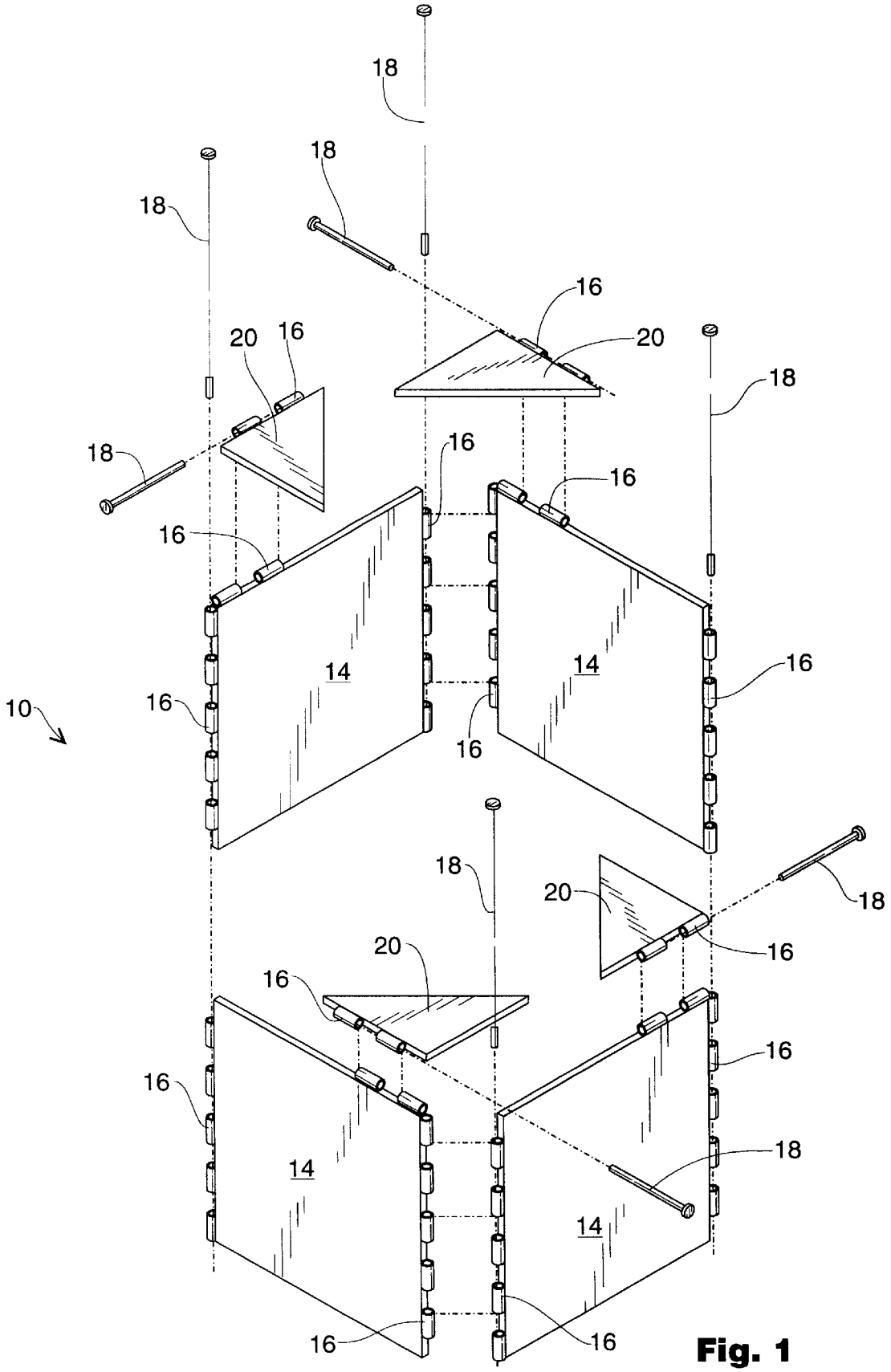
FIG. 1 is an exploded perspective view of the appliance enclosure of the present invention.
Figure 2:
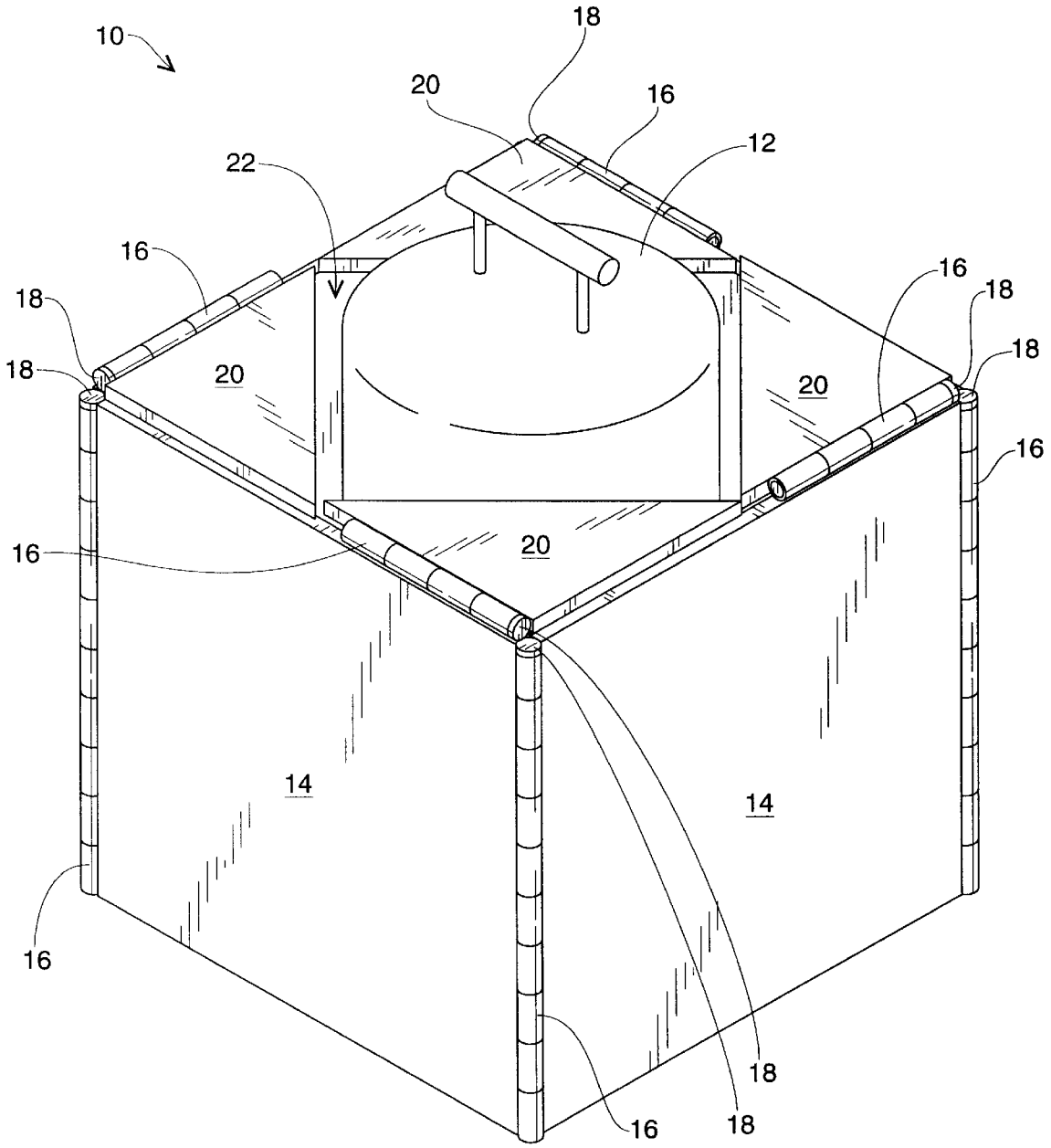
FIG. 2 is a perspective view of the appliance enclosure in use, surrounding an appliance.

FIG. 1 is an exploded perspective view of the appliance enclosure 10 of the present invention. FIG. 2 is a perspective view of the appliance enclosure 10 in use, surrounding an appliance 12. Referring to FIGS. 1 and 2, the enclosure 10 includes four rectangular, planar first walls 14. The first walls 14 are hingedly connected to each other to form the enclosure 10, using conventional hinge structures 16 with hinge pins 18.

One of the hinge pins 18 connecting the first walls 14 together may be loose fitting, so that the enclosure 10 can be opened by removing the hinge pin 18 and disengaging the hinge structures 16 from each other.

Alternatively, any two adjacent ones of the hinge structures 16 may be replaced by any type of conventional structure, such as latches or the like, for opening and closing the enclosure 10 around the appliance 12.

Each of the first walls 14 has a substantially triangular, substantially planar second wall 20 hingedly connected thereto, using hinge pins 18 and hinge structures 16 as described above for connecting the first walls 14 to each other. The second walls 20 are configured to rest in a substantially horizontal position extending from tops of the first walls 14 when the enclosure 10 is in use, as shown in FIG. 2. The second walls 20 form an enclosure lid having an opening 22 adapted to permit the appliance 12 to extend there-through.

If desired, all of the hinge pins 18 may be loose fitting, to allow the entire enclosure 10 to be easily assembled and disassembled.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. An appliance enclosure comprising:

four substantially rectangular, substantially planar first walls disposed in series relationship as a plurality of adjacent pairs of said first walls;

each said adjacent pair of said first walls having mutually cooperable edge portions with respective hinged connection means whereby said first walls are adapted to hingedly close around such an appliance with each of said first walls disposed substantially vertically;

hinge pins cooperably engaging said hinged connection means to provide hinged connection of said first walls in said series relationship, whereby said first walls are adapted to define a top opening through which such an appliance may extend when said first walls are hingedly closed around such an appliance; and each of said first walls having a respective substantially triangular, substantially planar second wall hingedly connected thereto and disposed to extend substantially horizontally from the tops of said first walls, respectively, in a manner that said second walls are mutually cooperable to form a lid for said enclosure which only partially closes said top opening to thereby permit such an appliance to extend therethrough.

2. The appliance enclosure as set forth in claim 1 wherein said second walls are movably connected to the respective ones of said first walls, whereby said second walls may be selectively moved between closed and open positions.

3. The appliance enclosure as set forth in claim 2 wherein said second walls are mutually cooperable in said closed position to leave open a portion of said top opening through which such an appliance may extend.

4. The appliance enclosure of claim 1 wherein said adjacent pairs of said first walls are connected by loosely fitting hinge pins, whereby said adjacent pairs of said first walls are easily separable from one another.

5. The appliance enclosure of claim 1 wherein said first walls are disposed in a substantially vertical position, and said second walls are disposed in a substantially horizontal position, when said enclosure is in use surrounding such an appliance.

* * * * *